US005803038A

United States Patent [19]

Ihara et al.

[11] Patent Number: 5,803,038

[45] Date of Patent: Sep. 8, 1998

[54] DYNAMIC VALVE MECHANISM FOR ENGINE

[75] Inventors: Tadato Ihara, Kawasaki; Fumio Akikawa, Tokyo; Toshihiro Kokubun, Yokohama; Mitsunori Murakami, Kawasaki, all of Japan

[73] Assignees: Mitsubishi Jidosha Kogyo Kabushiki Kaisha; Mitsubishi Jidosha Engineering Kabushiki Kaisha, both of Tokyo, Japan

[21] Appl. No.: 890,885

[22] Filed: Jul. 10, 1997

[30] Foreign Application Priority Data

Jul. 10, 1996 [JP] Japan ..... 8-180930

[51] Int. Cl.[6] ..... F02D 13/04

[52] U.S. Cl. ..... 123/321

[58] Field of Search ..... 123/321, 320, 123/322, 90.12, 90.16

[56] References Cited

U.S. PATENT DOCUMENTS

| | | | |
|---|---|---|---|
| 4,711,210 | 12/1987 | Reichenbach | 123/321 |
| 5,036,810 | 8/1991 | Meneely | 123/321 |
| 5,586,533 | 12/1996 | Feucht | 123/321 |
| 5,645,031 | 7/1997 | Meneely | 123/322 |
| 5,701,857 | 12/1997 | Hara | 123/90.16 |

FOREIGN PATENT DOCUMENTS

| | | | |
|---|---|---|---|
| 61-237843A | 10/1986 | Japan | 123/321 |
| 347410B2 | 7/1991 | Japan . | |
| 941926A | 2/1997 | Japan | 123/321 |

*Primary Examiner*—Raymond A. Nelli

[57] ABSTRACT

A dynamic valve mechanism for an engine which can make the overall height of the engine relatively small so as to provide easy loading of the engine on a vehicle. The dynamic valve mechanism comprises a cam shaft 35 disposed on a cylinder head 34, an exhaust cam 36 disposed on the cam shaft and drives an exhaust valve 42 through an exhaust rocker arm 40, a rocker shaft 45 serving as the center of rocking motion of the exhaust rocker arm, an exclusive cam 38 disposed side by side with the exhaust cam 36 on the cam shaft, an oil passage housing 49 disposed to pass through under the rocker shaft 45 and having its one end facing the exclusive cam 38 and the other end facing the exhaust valve 42, a master piston 50 operated by the exclusive cam 38 to supply a hydraulic pressure to the other end of the oil passage housing 49, and a slave piston 54 which, under the hydraulic pressure supplied by the operation of the master piston, opens the exhaust valve 42 at a timing different from the valve opening timing by the exhaust cam 36.

11 Claims, 5 Drawing Sheets

DYNAMIC VALVE MECHANISM FOR ENGINE

FIELD OF THE INVENTION

This invention relates to a dynamic valve mechanism for an engine, specifically to a dynamic valve mechanism for an engine which effects opening of an exhaust valve at a different timing from an ordinary timing by a cam other than an ordinary exhaust cam.

BACKGROUND OF THE INVENTION

In order to improve the performance of a vehicle for stopping or running thereof, various types of variable valve devices have been developed and put into practical use, such as, for example, a device adapted to open intake and exhaust valves at a different timing from an ordinary timing for opening intake and exhaust valves according to a running state of the vehicle, or to change a lift amount of intake and exhaust valves; or a device wherein an additional variable valve is added which is adapted to open intake and exhaust valves at a different timing in addition to an ordinary valve opening timing.

In addition, for such a variable valve device, there is a mechanism of a type which utilizes two cams having different cam profiles that are selectively switched to either one for driving the valve according to a state of running of the vehicle or an operation of the engine. Further, there is another mechanism which includes a cam having a different cam profile having a different valve opening timing from that of an ordinary cam. More specifically, it operates to open the valve in a normal stroke, and also operates to open the valve in a stroke which is different from the normal stroke.

An example of such type of variable valve device is disclosed in Japanese Patent Laid-Open Publication No. 60-252113.

As shown in FIG. 9, such conventional variable valve device comprises an engine 1 having a combustion chamber 2 provided with exhaust valves 3 (a pair of valves here) and intake valves 4 (a pair of valves here), and wherein the pair of exhaust valves 3 is opened and closed by an exhaust rocker arm 6 through a valve bridge 5, and the pair of intake valves 4 is opened and closed by an intake rocker arm 8 through a valve bridge 7. The valve bridges 5, 7 are so formed that each is in a T-shape in a side view, and is slidably placed respectively over a pin 501' and 701' which are protruding from a cylinder head 13, and both ends of each bridge are in pressure contact with the pair of exhaust valves 3 and the intake valves 4, respectively.

The exhaust rocker arm 6 and the intake rocker arm 8 are both supported by a rocker shaft 18 at their centers, respectively, and their other ends are disposed to face an exhaust cam and an intake cam (both not shown), and both cams are attached to a cam shaft 9 integrally therewith.

To the portion of the cam shaft 9 which faces each cylinder, a cam 10 for engine braking is attached integrally in addition to and between the exhaust and intake cams (not shown). The cam 10 is in pressure contact with a master piston 12 located at one end of a bracket 11 disposed between the exhaust rocker arm 6 and the intake rocker arm 8.

The bracket 11 is disposed on the cylinder head 13 to protrude therefrom and including a hydraulic oil passage 16 formed therein in a longitudinal direction, one end of which is communicated with the master piston 12 and the other end is communicated with a slave piston 14, with a solenoid valve 15 being arranged at the center. A valve-type pin 17, which is slidably inserted into a through-hole of the valve bridge 5, is in pressure contact with the upper end of a valve stem of one of the pair of exhaust valves 3.

The solenoid valve 15 effects communication between the hydraulic oil passage 16 and a distribution passage 19, which communicates to a hydraulic source during OFF-time, and shuts off both passages during ON-time, thereby the hydraulic oil passage 16 is closed.

Upon turning-OFF of the solenoid valve 15, the hydraulic oil passage 16 and the distribution passage 19 are communicated with each other, and as a result, an increase in oil pressure does not occur by driving of a master piston 12, thereby, both hydraulic oil passages are maintained in a predetermined oil pressure and the slave piston 14 is held in non-operative condition (i.e. this is the time when a compression pressure open type engine auxiliary brake is not operated). On the other hand, upon turning-ON of the solenoid valve 15, the hydraulic oil passage 16 is closed, and the cam 10 for the engine brake drives the master piston 12 near the time of completion of a compression stroke, whereupon the hydraulic slave piston 14 and the valve-type pin 17, which are interlocked with the master piston 12 through the hydraulic oil passage 16, are operated to open the exhaust valve 3. In this manner a high pressure gas in the cylinder 2 is exhausted, thereby absorbing the compression work, which, in turn, a kinetic energy of the vehicle is absorbed (i.e. the compression pressure open type engine auxiliary brake is operated).

As shown in FIG. 9, an OHC (overhead camshaft) type Diesel engine comprises the cam shaft 9 and the rocker shaft 18, both of which are supported on the cylinder head 13 through a mounting block 13', intake and exhaust cams (not shown) disposed at locations facing each cylinder, and the intake and exhaust rocker arms 8, 6. If, in addition, a compression pressure open type engine auxiliary brake is to be mounted, the bracket 11 needs to be supported by the mounting block 13' to bridge over the cam shaft 9 and the rocker shaft 18 at a location to face each cylinder. Further, the hydraulic oil passage 16, the master piston 12 and the slave piston 14, which are partially disposed in the oil passage, are mounted on the bracket 11.

However, with such structure of mounting the bracket 11 bridging over the rocker shaft 18, the overall height of the engine becomes higher, which causes inconvenience and disadvantage for loading the engine on the vehicle.

It is an object of the invention to provide a dynamic valve mechanism for an engine which can be made compact, since the overall height of the engine is made relatively small, thereby providing easy loading of the engine on the vehicle.

SUMMARY OF THE INVENTION

To achieve the above object, a dynamic valve mechanism for an engine according to the invention comprises:

- a cam shaft disposed on a cylinder head of the engine,
- an exhaust cam disposed on the cam shaft and drives an exhaust valve through an exhaust rocker arm,
- a rocker shaft serving as the center of rocking motion of the exhaust rocker arm,
- an exclusive cam arranged side by side with the exhaust cam on the cam shaft,
- an oil passage housing disposed to pass through under the rocker shaft and having its one end facing the exclusive cam and the other end facing the exhaust valve, a master piston which operates in response to the operation of the exclusive cam located at said one end of the oil passage housing and supplies a hydraulic pressure to the other end, and a slave piston arranged at said other end of the oil passage housing and opens the exhaust valve, under the hydraulic pressure supplied by the operation of the master piston, at a timing different from a valve opening timing by the exhaust cam.

According to this invention, the dynamic valve mechanism comprises the exclusive cam disposed side by side with the exhaust cam on the cam shaft, the oil passage housing having its one end facing the exclusive cam and the other end facing the exhaust valve, and, specifically, the oil passage housing is configured to pass through under the rocker shaft. With this structure, a space can be secured above the rocker shaft and the cam shaft, so that the height of the engine can be lowered to make the engine body compact, or such space can be effectively used for other purposes, for example, for mounting a breather there.

Further, in the dynamic valve mechanism of the present invention, the master cylinder is arranged below the cam shaft in an axial direction of the cylinder to eliminate the oil passage housing from above the camshaft, which, in turn, provides a further space, resulting in lowering the height of the engine further.

Yet further, in the dynamic valve mechanism of the present invention, the master cylinder is located near the exhaust valve than to the cam shaft.

Even still further, in the dynamic valve mechanism for an engine of the present invention, a central axis of the master cylinder is at an angle with respect to a longitudinal axis of the exhaust valve.

More specifically, the master cylinder is disposed on the side of exhaust valve which is at the center of the engine body, rather than on the side of the cam shaft, so that the size in the direction of width which is orthogonal to the longitudinal direction of the engine body can be restrained, and this results in making the engine body compact.

Still further, in the dynamic valve mechanism of the present invention, the master cylinder is fastened to the cylinder head by a head bolt which fastens the cylinder head and a cylinder block.

More specifically, the master cylinder is fastened to and together with the cylinder head by the head bolt, which eliminates the necessity of having a bolt exclusively for fastening the master cylinder, thereby the number of parts can be reduced.

Further, in the dynamic valve mechanism of the present invention, the slave piston is formed separately from the oil passage housing and, at its side face, connected with the oil passage housing to communicate with the oil passages.

More specifically, the portion containing the slave piston is formed separately from the oil passage housing, so that it can be attached and assembled later. Namely, the master cylinder is assembled first at the same time with an assembly of the ordinary dynamic valve system, and, thereafter, the slave piston can be assembled therewith, so that the workability in assembly is improved.

Yet further, in the dynamic valve mechanism of the present invention, the slave cylinder is fastened to the oil passage housing by an eye bolt so that mounting areas between the slave cylinder and the oil passage housing can be made smaller, and the workability in assembly is improved further.

Further, in the dynamic valve mechanism of the present invention, the exclusive cam has a lift schedule for opening the exhaust valve in the neighborhood of the top dead center in the compression stroke.

Still further, in the dynamic valve mechanism of the present invention, the oil passage housing includes an operation oil passage, and the cylinder head includes a distribution passage for providing hydraulic pressure to the operation oil passage, wherein a first end of the operation oil passage is connected to the slave piston and a second end of the operation oil passage is connected to the distribution passage.

A dynamic valve mechanism according to present invention, comprises:

a control valve disposed in the distribution oil passage, the control valve selectively connecting and disconnecting the distribution passage and the operation oil passage.

A dynamic valve mechanism according to present invention, further comprises:

a solenoid valve disposed in the distribution oil passage, the solenoid valve selectively applying a first hydraulic pressure to the slave piston through the operating oil passage such that the slave piston opens the exhaust valve when the master piston operates, and applying a second hydraulic pressure to the slave piston through the operation oil passage such that the operation of the master piston does not affect the opening of the exhaust valve, the first hydraulic pressure being higher than the second hydraulic pressure.

Therefore, the mechanism can fully function as a compression pressure open type engine brake.

DETAILED DESCRIPTION OF EMBODIMENTS

Figure 1:
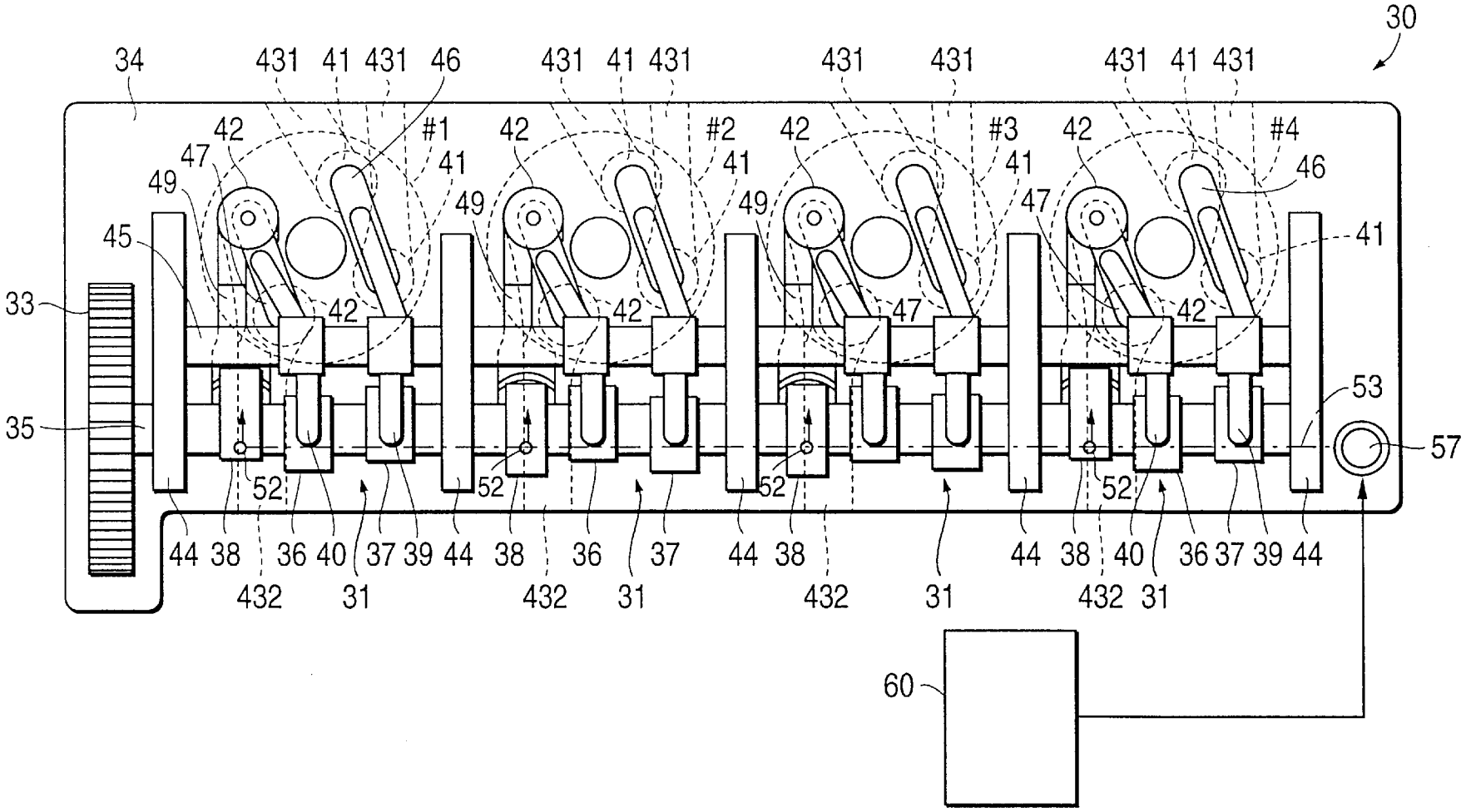
FIG. 1 is a schematic structural view of a cylinder head of an engine equipped with a dynamic valve mechanism for the engine according to the present invention.

In FIG. 1, a Diesel engine 30 (hereinafter referred to simply as "the engine") of a vehicle is shown, and a dynamic valve mechanism 31 for the engine of the present invention is mounted on the engine as applied according to the present invention.

The engine 30 is a 4-cylinder type and includes an OHC type dynamic valve system. A cylinder head 34, which contains the dynamic valve system, a cylinder block, a crank case, and the like (which are not shown) are successively stacked below the cylinder head, and they are integrally connected together by head bolts 59, 59' which will be described hereinafter.

The engine 30 is structured such that each of the cylinders #1~#4 is provided with a pair of intake valves 41 and a pair of exhaust valves 42, which interrupt communication between the inside of each cylinder and an intake port 431 and an exhaust port 432, and, particularly, the dynamic valve mechanism 31 for an compression pressure open type engine brake is provided for each of the cylinders #1~#4.

The dynamic valve system of the engine 30 is arranged such that the rotation of a crank shaft (not shown) is received by a cam shaft gear 33 through a plurality of timing gears (not shown). To this cam shaft gear 33, one end of a cam shaft 35 rotatably supported on the cylinder head 34 is connected integrally, and the cam shaft 35 carries thereon, an intake cam 36 and an exhaust cam 37 as well as an exclusive cam 38 adjacent to the former two cams, which are arranged successively to face each cylinder.

Here, the intake and exhaust cams 37, 36 are connected to intake and exhaust valves 41, 42 through intake and exhaust rocker arms 39, 40 and valve bridges 46, 47. The intake cam 37 and the exhaust cam 36 operate to open respective valves in an intake stroke or an exhaust stroke, as shown in FIG. 6.

Figure 6:
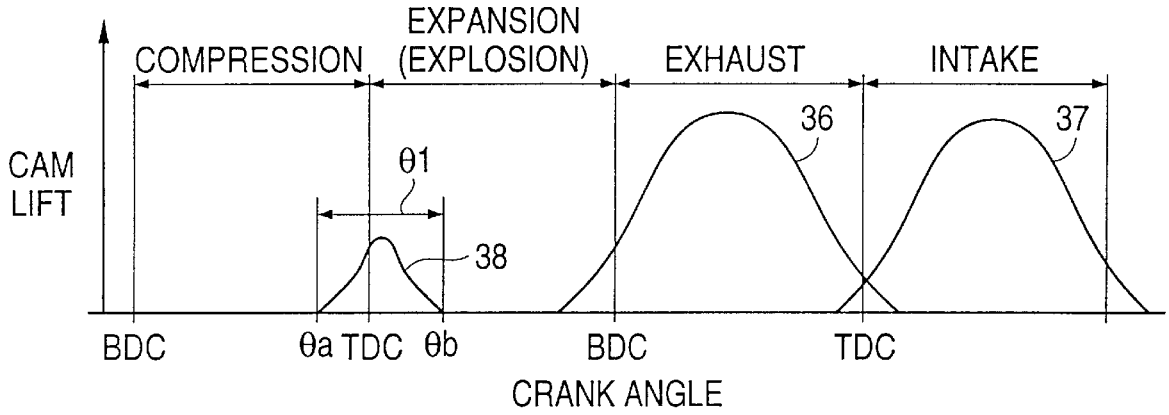
FIG. 6 shows a motion diagram of a lift operation of the intake and exhaust cams and the exclusive cam employed by the dynamic valve mechanism and the compression pressure open type engine brake of the engine as shown in FIG.

The exclusive cam 38 has a lift schedule to perform a lift operation at a valve opening angle θ1, as shown in FIG. 6, to open the valve at a cam angle θa before the compression top dead center TDC in each cylinder, and close the valve at an angle θb after the top dead center. The valve opening angle θ1 is set to such a timing that a high pressure gas is exhausted into the exhaust port 432 after sufficient work of compression has been done by each cylinder, namely, a timing for securing a sufficient absorption horse power when the compression pressure open type engine auxiliary brake is applied.

Figure 3:
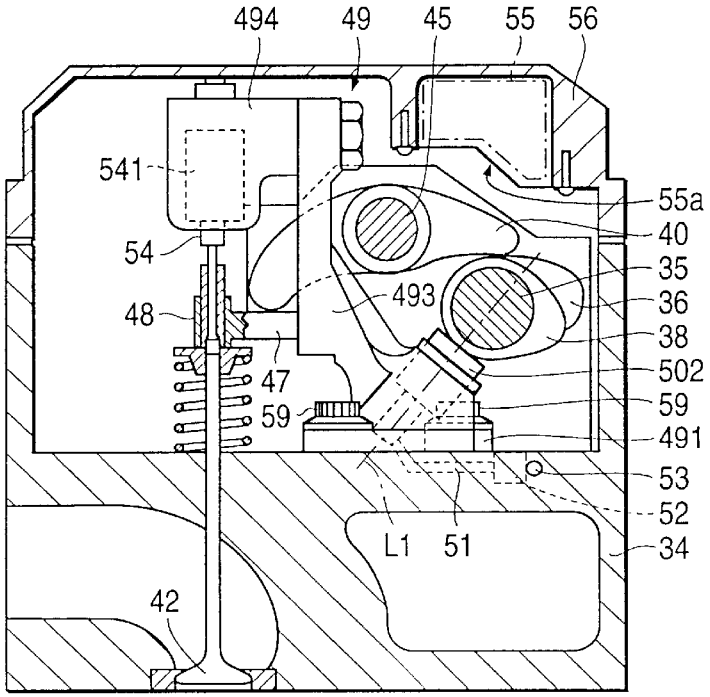
FIG. 3 is a schematic enlarged sectional view of the essential portion of the cylinder head of the engine as shown in FIG. 1.
Figure 9:
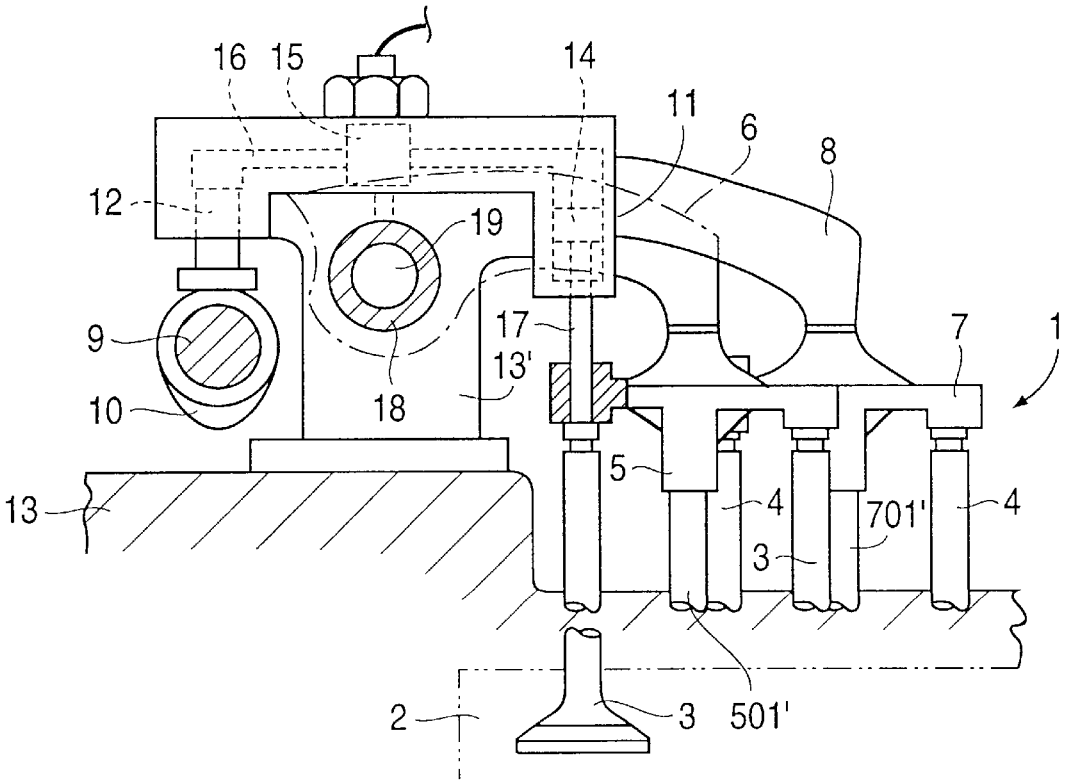
FIG. 9 a schematic sectional view of the essential portions of a conventional dynamic valve mechanism for the engine.

The cam shaft 35 is rotatably supported by the upper wall of the cylinder head 34 through a plurality of bearing members 44, and a rocker shaft 45 is disposed side by side with this cam shaft 35, and the rocker shaft 45 is also supported by the plurality of bearing members 44. Intake and exhaust rocker arms 39, 40 are, at their respective centers, mounted on the rocker shaft 45, and one end of each arm is in pressure contact with intake and exhaust cams 37, 36, respectively. The other end of each of the intake and exhaust rocker arms 39, 40 is in pressure contact with the center of valve bridges 46, 47, respectively. The valve bridges 46, 47 are in T-shape in a side view, and so formed, as similar to the conventional arrangement shown in FIG. 9, to vertically slidably movable over pins (not shown) which are vertically protruding from the cylinder head 34, thereby the right and left ends are in pressure contact with the pair of exhaust valves 42 (only one is shown in FIG. 3). Here, a valve-type pin 48 slidably inserted into a through-hole, which is vertically formed in the valve bridge 47, is in pressure contact with the upper end of one of the pair of exhaust valves 42.

An oil passage housing 49 is mounted on the upper wall of the cylinder head 34 at a position to face each cylinder.

Figure 2:
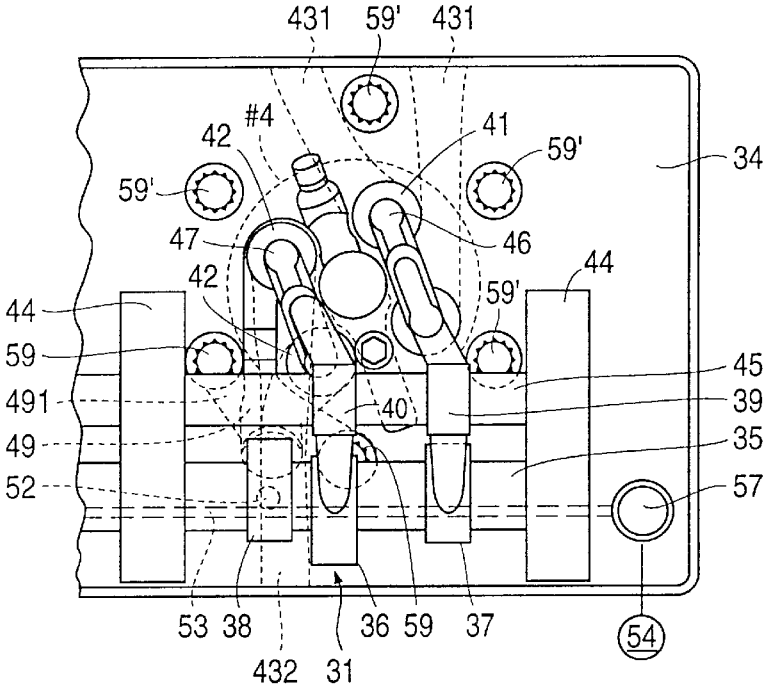
FIG. 2 is an enlarged plan view of a partially cut-off portion of the cylinder head of the engine as shown in FIG. 1.
Figure 4:
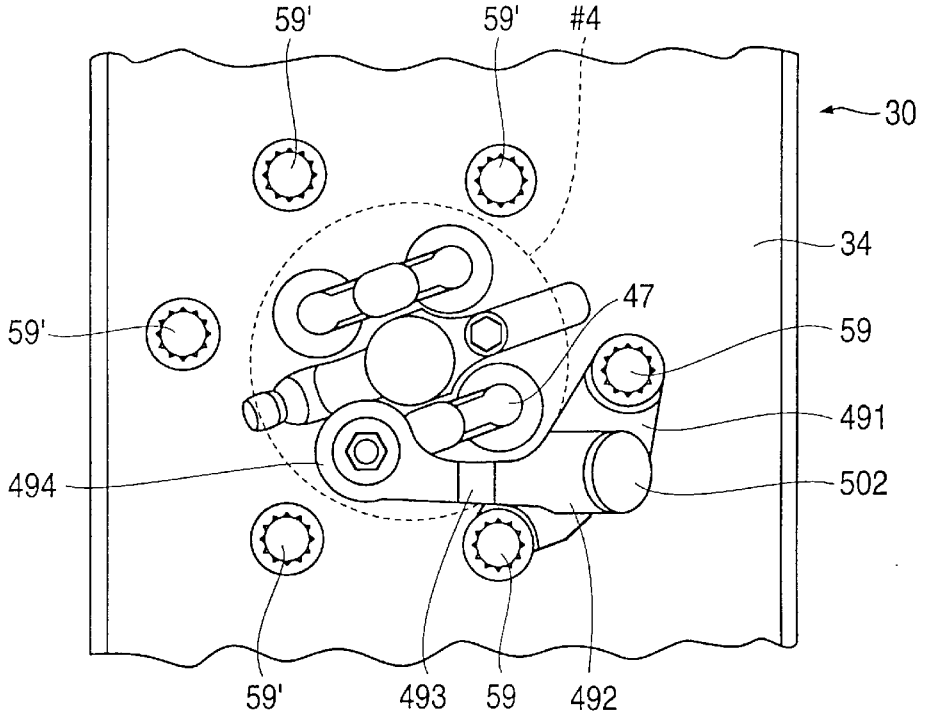
FIG. 4 is an enlarged plan view of the essential portion of the oil passage housing in the cylinder head of the engine as shown in FIG. 1.

FIGS. 2 to 4 illustrate the oil passage housing 49 of the cylinder #4 of the four cylinders.

The oil passage housing 49 includes at its lower portion a mounting portion 491, and the mounting portion 491 is in a curved form in a plan view as shown in FIG. 4. Further, this mounting portion 491 is so formed to overlap a track of arrangement of six (6) head bolts 59, 59' successively in a ring form at substantially an equal interval on the outer periphery of the cylinder #4.

Here, the mounting portion 491 includes a through-hole (not shown) in both ends respectively, into which two head bolts 59 can be inserted.

More specifically, the two head bolts 59 as well as another four head bolts 59' are inserted into the cylinder head 34 and a cylinder block (not shown), respectively, and upon tightening of each bolt, the assembly of the engine body is achieved. In this embodiment, during assembly of the engine body, the mounting portion 491 of the oil passage housing 49 is fastened to the cylinder head 34 integrally therewith by tightening the two head bolts 59 simultaneously.

As described above, the mounting portion 491 and the cylinder head 34 are fastened together, and this eliminates the requirement of an additional and exclusive fastening bolt, which in turn, provides an advantage of reducing the number of parts. Specifically, since the mounting portion 491 of the oil passage housing 49 can be disposed to overlap the track of arranging the six head bolts 59, 59', it eliminates the requirement of securing a separate space for positioning the mounting portion 491, namely, it provides easy securing of the space for attaching the mounting portion 491.

Figure 5:
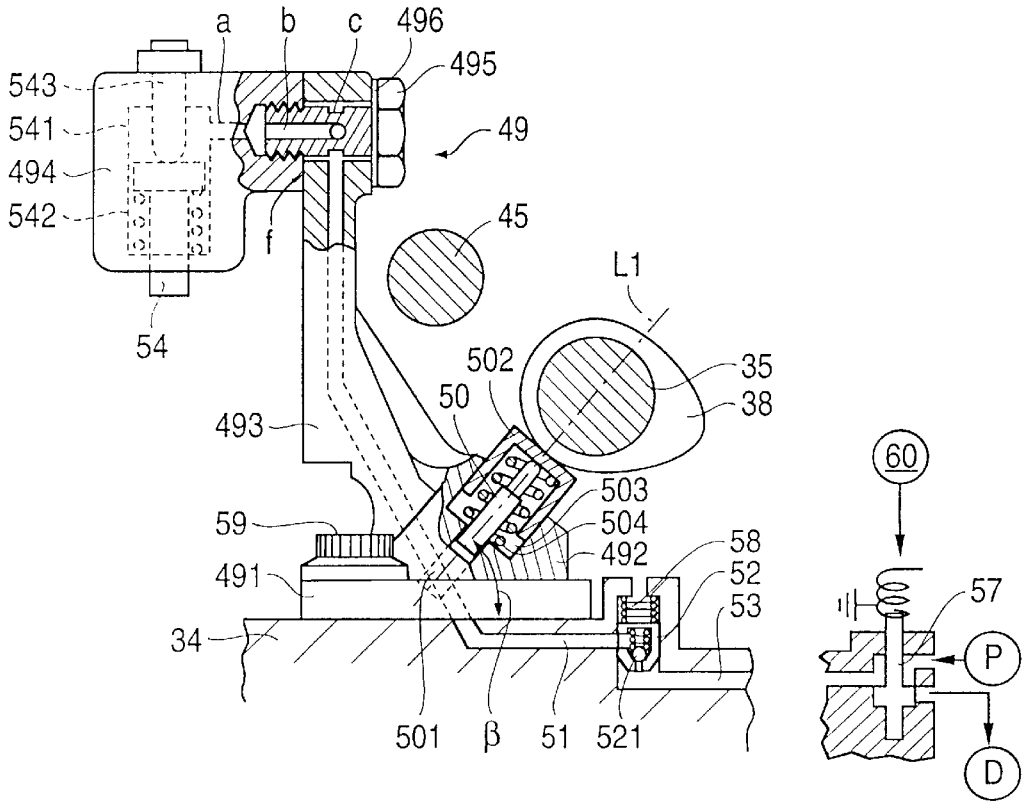
FIG. 5 is an enlarged and partially cut-off sectional side view of the oil passage housing in the cylinder head of the engine as shown in FIG. 1.

As shown in FIG. 3, FIG. 4, and FIG. 5, the oil passage housing 49 has an expanded portion 492 integrally formed immediately above the mounting portion 491, and a pillar-shape portion 493 extending further upwardly from the expanded portion 492, and, further, a protruding portion 494 is brought into pressure contact with a vertical wall f at the upper end of the pillar-shape portion 493, and both are connected together integrally by an eye bolt 495.

The mounting portion 491 and the expanded portion 492 are disposed immediately below the cam shaft 35 and the rocker shaft 45, and the pillar-shape portion 493 is extending upwardly straight from a position where it does not interfere with the cam shaft 35 and the rocker shaft 45 of the expanded portion 492. Further, the back-face of the pillar-shape portion 493 is facing the cam shaft 35 and the rocker shaft 45 at a predetermined space, and the eye bolt 495 inserted into a through-hole 496 from the back of the pillar-shape portion is screw-mounted to the protruding portion 494 which is in pressure contact with the vertical wall opposite the back-face of the pillar-shape portion 493.

The expanded portion 492 is formed with a master cylinder 501 along an inclined axis L1, and a master piston 50 facing the exclusive cam 38 is contained therein. The master piston 50 is connected to a plunger 502 having a greater diameter than the master piston, and this plunger 502 is in pressure contact with the exclusive cam 38. A plunger hole 503 for guiding the plunger 502 contains therein a spring 504 for pressing the plunger 502 towards the exclusive cam 38.

Figure 7:
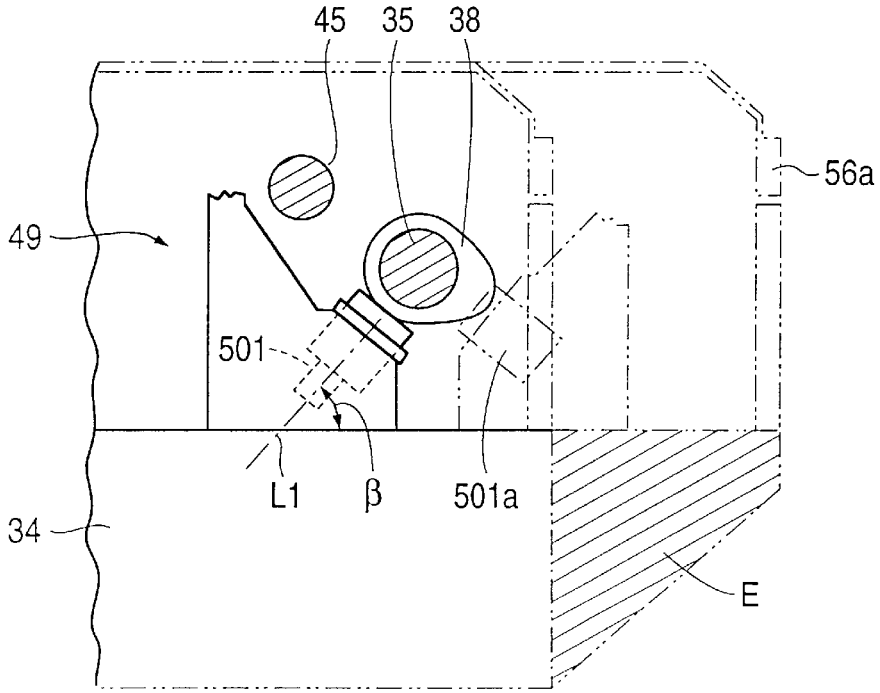
FIG. 7 shows schematically an arrangement of a modification of this invention in the vicinity of the master cylinder used in the dynamic valve mechanism for the engine according to the present invention.

As shown in FIG. 7 in a two-dotted line or a solid line, in comparing with the arrangement where the master cylinder 501*a* is disposed at the side end of the cylinder head 34, the arrangement where the master cylinder 501 is disposed at the side of the center of the cylinder head, with its inclined axis L1 having a torsion angle β, allows to set the overall engine width to a relatively small size and eliminates the inconvenience of having a dead space E immediately below a laterally projection portion of a rocker cover 56*a*. Master cylinders 501 is disposed lower than the cam shaft 35, and, therefore, leaves a space above the cam shaft 35.

Further, the master cylinder 501 having the torsion angle βis disposed for avoiding the master cylinder 501 to be located immediately under the cam shaft 35, and this arrangement provides the advantage of making the overall engine height relatively small.

With thus arranged master cylinder 501, its lower opening communicates with an operating oil passage 51 on the side of the cylinder head 34, and its upper opening communicates with the operating oil passage 51 vertically formed in the pillar-shape portion 493.

As shown in FIG. 5, the operating oil passage 51, extending to the side of cylinder head 34, is communicated with a distribution passage 53 through a control valve 52.

The control valve 52, having a check valve 521, is raised as a pressure in the distribution passage 53 increases, thereby connecting the operating oil passage 51 with the distribution passage 53 by a high pressure oil applied to the check valve 521, and lowered by a spring 58 as the pressure decreases, thereby disconnecting the operating oil passage 51 from the distribution passage 53.

The operating oil passage 51 for each cylinder merges with the distribution passage 53 through the control valve 52, and one end of the distribution passage 53 is in communication with a solenoid valve 57 as shown in FIG. 1 and FIG. 2. The distribution passage 53 is selectively communicated with a hydraulic pump P and a drain passage D through the solenoid valve 57. Here, the solenoid valve 57 is operated by a controller 60, which is a known electronic control device, to decrease the pressure in the distribution passage 53 during OFF time and to increase the pressure in the distribution passage 53 during ON time to open the control valve 52, thereby switching the operating oil passage 51 to a closed circuit state as shown in FIG. 5.

When the operating oil passage 51 is in the closed circuit state, the exclusive cam 38 drives a master piston 502, upon which a slave piston 54 of a slave cylinder 541, which is interlocked with the master cylinder 501 through the operating oil passage 51, is protruded and operated, thereby effecting opening of the exhaust valve 42 through the valve-type pin 48.

As shown in FIG. 5, an overhanging portion 494 is connected integrally with the vertical wall f located on the side of the exhaust valve 42 in the pillar shape portion 493, by an eyebolt 495. The overhanging portion 494 contains the slave cylinder 541 formed therein and the slave piston 54 inserted therein with the lower end thereof, which is the leading end of the slave piston, is disposed to face the valve-type pin 48 supported by the valve bridge 47. Immediately below the valve-type pin 48, there is the other exhaust valve 42 disposed in pressure contact with the pin 48.

The slave cylinder 541 is in communication with the operating oil passage 51 at the upper end of the pillar-shape portion 493 through a horizontal oil passage a in the overhanging portion 494, a central oil passage b in the eye bolt 495, and a ring shape oil passage c communicating with the oil passage b. Below the slave cylinder 541, a spring 542 is disposed, by which the slave piston 54 is pressed to a position where it presses against a stopper 543.

The overhanging portion 494 containing the slave piston 54 as described above is formed separately from the oil passage housing body comprising the pillar-shape portion 493, the mounting portion 491 and the expanded portion 492, and connected to the oil passage housing body by the eye bolt 495 integrally and in communication with the operating oil passage 51.

With the above described structure, during assembly of the engine, the overhanging portion 494 may be assembled to the engine body afterwards. Specifically, only the oil passage housing body, without the overhanging portion 494, is formed first during assembly of the engine body. Then, respective members of the dynamic valve system including the intake and exhaust valves 41, 42 are assembled on the cylinder head 34, followed by arranging the overhanging portion 494 above the intake and exhaust valves 41, 42, bringing it in pressure contact with the vertical wall f of the pillar-shape portion 493, and connecting it to the oil passage housing body by the eye bolt 495 to achieve the assembly.

Consequently, the overhanging portion 494 cannot be a disturbance during assembly of respective members of the dynamic valve system, and results in improving workability in assembly.

The above description has been made specifically for the #4 cylinder of the four-cylinder engine and the associated head bolts 59, 59', as well as the dynamic valve system and hydraulic circuits, by referring to FIG. 2 to FIG. 4. But it is apparent that the same structure is adopted for each of the rest of cylinders, and repetition of the description is omitted.

Figure 8:
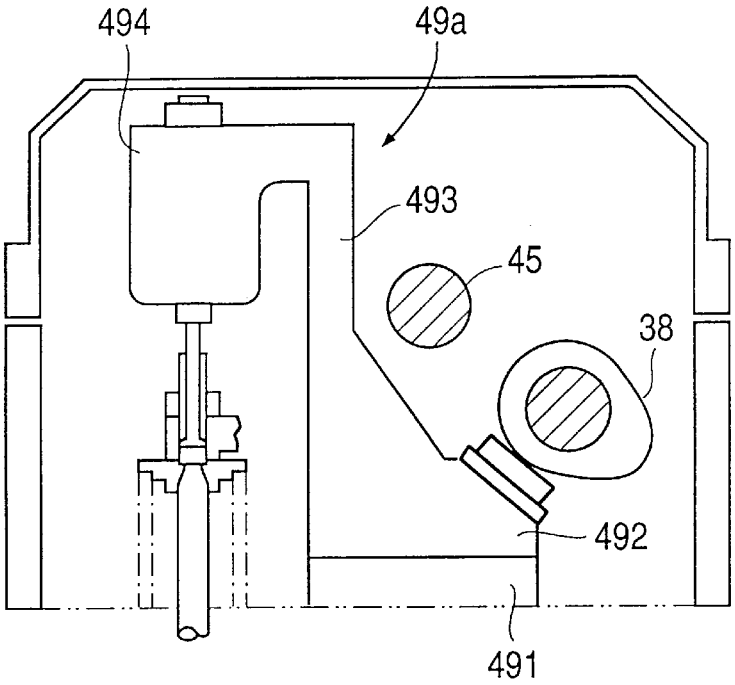
FIG. 8 shows schematically an arrangement of the oil passage housing used in the dynamic valve mechanism for the engine, as a modification of the present invention.

The above-described oil passage housing 49 is so configured that the master cylinder 501 is located below the cam shaft 35, namely, in the lower portion in the axial direction of the cylinder, and the slave cylinder 541 is located above the exhaust valve 42, so that they can be in communication with each other by means of the operating oil passage 51. Specifically, the overhanging portion 494, which can be assembled afterwards with the mounting portion 491, the expanded portion 492, and the pillar-shape portion 493, can be formed to have operating oil passage 51 continuously communicating therethrough, so that the workability in engine assembly is improved. However, if there is no problem in the workability in engine assembly, an oil passage housing 49*a* including the mounting portion 491, the expanded portion 492, the pillar-shape portion 493 and the overhanging portion 494 as an integral body, as shown in FIG. 8, may be used. In this case, a simplified structure can be achieved.

The above-described oil passage housing 49 facing each cylinder is arranged to pass through under the cam shaft 35 and the rocker shaft 45, so that it leaves a space facing the oil passage housing 49 above the cam shaft 35 and the rocker shaft 45.

Consequently, in such upper space, a breather 55, for example, as shown in FIG. 3, may be arranged therein to use the space effectively. Such breather 55 may be housed in a container chamber 55*a* provided to extend from the inner wall of the rocker cover 56. Thus, the breather 55 does not protrude from the rocker cover 56 upwardly, thereby reducing the overall height of the engine.

Description will be made of operation of the above-described dynamic valve mechanism for engine and operation of the compression pressure open type engine auxiliary brake, by referring to FIG. 2 and FIG. 5.

Generally, during running of the vehicle, in the dynamic valve system of the engine 30, the intake and exhaust cams 37, 36 are operated to open and close in the intake and exhaust strokes in each cylinder, and responsive to that driving operation the intake and exhaust rocker arms 39, 40 are operated to open and close the intake and exhaust valves 41, 42.

During that time, the controller 60 holds the solenoid valve 57 in the OFF state; the distribution passage 53 is communicated with the drain passage D; and the control valve 52 is lowered, so that the operating oil passage 51 is opened to the atmosphere. Therefore, the master cylinder 501 and the slave cylinder 541 are not interlocked hydraulically; the slave piston 54 is held in the floating state by the spring 542; and the master piston 50 makes only idle operation.

On the other hand, when a combination switch (not shown) in the driver's cabin is turned on, an auxiliary brake signal is input into the controller 60, upon which the controller 60 holds the solenoid valve(SOL)in the ON state; the distribution passage 53 is communicated with the hydraulic pump P; and the control valve 52 is raised. Then, the operating oil passage 51 is held in the closed circuit state, and the master piston 50 and the slave piston 54 are hydraulically interlocked.

In this case, specifically, both exhaust valves 42 make the open and close operations in the exhaust stroke, and the slave piston 54 is projected and operated by interlocking, through the master piston 50, with the lift operation of the exclusive cam 38 which is made in the area of θ1 (see FIG. 5) near the compression top dead center, thereby opening the exhaust valve 42 to exhaust a high pressure gas in the cylinder to the exhaust port 432.

As described above, the dynamic valve mechanism of the engine can, at the time when an auxiliary brake signal is input, absorb the compression work by exhausting the high pressure gas in each cylinder in the neighborhood of the compression top dead center, thereby absorbing a kinetic energy of the vehicle. Thus, the dynamic value mechanism can operate as a compression pressure open type engine brake.

The dynamic valve mechanism for the engine of this invention is characterized by the arrangement, shape and assembly of the oil passage housing. The cam profile of the exclusive cam is not limited to the one which allows the exhaust valve to be opened in the neighborhood of the compression top dead center.

In other words, an ordinary cam mechanism which stops the operation of the exhaust valve may be added so as to be used by switching between the ordinary exhaust cam and the exclusive cam depending on a high or low running speed of the vehicle.

It is to be understood that the invention is by no means limited to the specific embodiments which have been illustrated and described herein, and that various modifications thereof may indeed be made which come within the scope of the present invention as defined by the appended claims.

What is claimed is:

1. A dynamic valve mechanism for an engine, comprising:

a cam shaft disposed on a cylinder head of the engine;

an exhaust cam disposed on the cam shaft, said exhaust cam driving an exhaust valve through an exhaust rocker arm;

a rocker shaft pivotally supporting the exhaust rocker arm;

an exclusive cam disposed side by side with the exhaust cam on the cam shaft;

an oil passage housing disposed under the rocker shaft, said oil passage housing having one end thereof facing the exclusive cam and the other end thereof facing the exhaust valve;

a master piston which operates in response to an operation of the exclusive cam, said master piston being located approximate said one end of the oil passage housing and supplies hydraulic pressure to the other end; and a slave piston provided approximate said other end of the oil passage housing said slave piston opening the exhaust valve at a timing different from the valve opening timing by the exhaust cam under the hydraulic pressure supplied thereto by the operation of said master piston.

2. A dynamic valve mechanism for the engine according to claim 1, wherein the master cylinder is disposed below the cam shaft in an axial direction of the cylinder.

3. A dynamic valve mechanism for the engine according to claim 2, wherein the master cylinder is disposed on the side of the exhaust valve, rather than the side of the cam shaft.

4. A dynamic valve mechanism for an engine according to claim 2, wherein a central axis of said master cylinder is at an angle with respect to a longitudinal axis of the exhaust valve.

5. A dynamic valve mechanism for the engine according to claim 1, wherein the master cylinder is fastened to the cylinder head by a head bolt which fixes the cylinder head and a cylinder block.

6. A dynamic valve mechanism for the engine according to claim 1, wherein the slave piston is formed separately from the oil passage housing, said slave piston being connected to the oil passage housing at a side thereof such that the oil passage communicates with said slave piston.

7. A dynamic valve mechanism for the engine according to claim 6, wherein the slave cylinder is fastened to the oil passage housing by an eye bolt.

8. A dynamic valve mechanism for the engine according to claim 1, wherein the exclusive cam has a lift schedule for opening the exhaust valve in the neighborhood of a top dead center in a compression stroke.

9. A dynamic valve mechanism according to claim 1, wherein said oil passage housing includes an operation oil passage, and said cylinder head includes a distribution passage for providing hydraulic pressure to said operation oil passage, wherein a first end of said operation oil passage is connected to said slave piston and a second end of said operation oil passage is connected to said distribution passage.

10. A dynamic valve mechanism according to claim 9, further comprising:

a control valve disposed in said distribution oil passage, said control valve selectively connecting and disconnecting said distribution passage and said operation oil passage.

11. A dynamic valve mechanism according to claim 9, further comprising:

a solenoid valve disposed in said distribution oil passage, said solenoid valve selectively applying a first hydraulic pressure to said slave piston through said operating oil passage such that said slave piston opens the exhaust valve when said master piston operates, and applying a second hydraulic pressure to said slave piston through said operation oil passage such that the operation of said master piston does not affect the opening of the exhaust valve, said first hydraulic pressure being higher than said second hydraulic pressure.

* * * * *